US012768255B2

(12) United States Patent
Narhi et al.

(10) Patent No.: US 12,768,255 B2
(45) Date of Patent: Oct. 20, 2026

(54) METHODS FOR ADJUSTING TREATMENT SCHEDULES FOR HYDRAULIC FRACTURING OPERATIONS TO LIMIT PUMP TIME, PUMP VOLUME, AND/OR PUMP RATE

(71) Applicant: ExxonMobil Technology and Engineering Company, Spring, TX (US)

(72) Inventors: Ward E. Narhi, Kingwood, TX (US); Yueming Liang, Sugarland, TX (US); Holger A. Meier, Montgomery, TX (US); Steve Lonnes, Spring, TX (US)

(73) Assignee: ExxonMobil Technology and Engineering Company, Spring, TX (US)

( * ) Notice: Subject to any disclaimer, the term of this patent is extended or adjusted under 35 U.S.C. 154(b) by 390 days.

(21) Appl. No.: 18/600,077

(22) Filed: Mar. 8, 2024

(65) Prior Publication Data

US 2024/0337177 A1 Oct. 10, 2024

Related U.S. Application Data

(60) Provisional application No. 63/494,547, filed on Apr. 6, 2023.

(51) Int. Cl.

| | |
|---|---|
| ***E21B 43/26*** | (2006.01) |
| ***E21B 47/06*** | (2012.01) |
| ***E21B 49/00*** | (2006.01) |

(52) U.S. Cl.

CPC ..... *E21B 43/26* (2013.01); *E21B 47/06* (2013.01); *E21B 49/006* (2013.01); *E21B 2200/20* (2020.05)

(58) Field of Classification Search

CPC ..... E21B 49/006; E21B 47/06; E21B 43/26; E21B 2200/20

See application file for complete search history.

(56) References Cited

U.S. PATENT DOCUMENTS

2017/0030173 A1* 2/2017 MacPHAIL ..... E21B 17/1035
2020/0386081 A1* 12/2020 Chen ..... E21B 33/13
2022/0372857 A1* 11/2022 Yeung ..... E21B 43/2607

FOREIGN PATENT DOCUMENTS

WO WO-2024050340 A1 * 3/2024 ..... E21B 47/11
WO WO-2025250230 A1 * 12/2025 ..... E21B 43/2605

OTHER PUBLICATIONS

Anumah, Prosper et al."Application of Artificial Intelligence Techniques to Well Spacing Optimization in Fractured Tight Reservoirs", Thesis submitted to the Faculty of Graduate Studies and Research, Nov. 4, 2022, 149 pages.

(Continued)

*Primary Examiner* — Sujoy K Kundu

(74) *Attorney, Agent, or Firm* — Troutman Pepper Locke LLP

(57) ABSTRACT

A method for adjusting the treatment schedule for a hydraulic fracturing operation corresponding to a hydrocarbon well to limit one or more pumping parameters (e.g., the pump time, pump volume, and/or pump rate) includes analyzing fracture diagnostic data and/or fracture model data to estimate the pumping parameter(s) at which the maximum number of hydraulic fractures will approximate a target fracture dimension during the hydraulic fracturing operation. The method also includes adjusting the treatment schedule for the hydraulic fracturing operation based on the estimated pumping parameter(s) and then hydraulic fracturing the hydrocarbon well according to the adjusted treatment schedule.

19 Claims, 10 Drawing Sheets

(56) References Cited

OTHER PUBLICATIONS

Tariq Zeeshan et al., "Asystematic review of data science and machine learning applications to the oil and gas industry", Journal of Petroleum Exploration and Production Technology, vol. 11, No. 12, Sep. 24, 2021, 36 pages.
International Search Report and Written Opinion, dated Sep. 15, 2023 issued in related PCT Application No. PCT/US2023/068185, 10 pages.

* cited by examiner

METHODS FOR ADJUSTING TREATMENT SCHEDULES FOR HYDRAULIC FRACTURING OPERATIONS TO LIMIT PUMP TIME, PUMP VOLUME, AND/OR PUMP RATE

CROSS-REFERENCE TO RELATED APPLICATION

This application claims priority to and the benefit of U.S. Provisional Application No. 63/494,547, entitled "Methods for Adjusting Treatment Schedules for Hydraulic Fracturing Operations to Limit Pump Time, Pump Volume, and/or Pump Rate," having a filing date of Apr. 6, 2023, the disclosure of which is incorporated herein by reference in its entirety.

FIELD OF THE INVENTION

The techniques described herein relate generally to the field of hydrocarbon well completions and hydraulic fracturing operations. More specifically, the techniques described herein relate to methods for adjusting treatment schedules for hydraulic fracturing operations to limit pump time, pump volume, and/or pump rate.

BACKGROUND OF THE INVENTION

This section is intended to introduce various aspects of the art, which may be associated with embodiments of the present techniques. This discussion is believed to assist in providing a framework to facilitate a better understanding of particular aspects of the present techniques. Accordingly, it should be understood that this section should be read in this light, and not necessarily as admissions of prior art.

Low-permeability hydrocarbon reservoirs are often stimulated using hydraulic fracturing techniques. Hydraulic fracturing consists of injecting a volume of fracturing fluid through created perforations and into the surrounding reservoir at such high pressures and rates that the reservoir rock in proximity to the perforations cracks open, resulting in the creation of hydraulic fractures that propagate within the formation. A proppant (e.g., typically consisting primarily of sand and/or ceramic beads) is then pumped into the created hydraulic fractures along with the fracturing fluid to hold the hydraulic fractures open after the hydraulic pressure has been released following the hydraulic fracturing operation. In this manner, the created hydraulic fractures provide a long-term increase in fluid permeability within the near-wellbore region of the formation, thus permitting hydrocarbon fluids to flow into the wellbore and then be produced at the surface.

A hydraulic fracturing operation involves dividing the fractured portion of the wellbore into stages, where each stage is stimulated separately, starting with the deepest stage and proceeding incrementally to the shallowest stage. Each stage has a number of perforation clusters spaced along the length of the stage, and each perforation cluster includes perforations that focus the flow of the fracturing fluid and, thus, induce the creation of a corresponding hydraulic fracture. Therefore, as each stage is stimulated separately, the number of hydraulic fractures created for each stage is generally limited by the number of perforation clusters in the stage.

During a typical hydraulic fracturing operation, the pumps are turned on to increase the pressure within the wellbore until the hydraulic fractures begin to form, and the pumping of the fracturing fluid is then continued for a predetermined amount of time (i.e., according to a planned treatment schedule), at which point the pumps are turned off to cease the pumping of fracturing fluid downhole. However, during this process, the operator is unaware of the state of the fracture growth within the subsurface and, thus, simply follows the pumping schedule to its planned conclusion. Ideally, all perforation clusters would experience identical fracture growth in order to optimize the created fracture field and, thus, maximize hydrocarbon recovery. In other words, in an ideal case, all the perforation clusters within the corresponding stage would produce hydraulic fractures that grow together to reach their final, target fracture dimension (e.g., target fracture length or target fracture height). Unfortunately, however, this is rarely the case since the perforation clusters are not all stimulated equally for a variety of reasons and, as a result, the hydraulic fractures in each stage do not all grow at the same rate or to the same extent. In particular, some perforation clusters will experience faster fracture growth during the treatment (thus reaching their target fracture dimension), while other perforation clusters will experience slower fracture growth and still other perforation clusters will not experience any fracture growth at all.

Moreover, there is currently not an effective procedure for determining the point at which the maximum number of hydraulic fractures have achieved their target fracture dimension during the pumping process. As a result of this lack of knowledge, the pumping process is continued until the end of the planned treatment schedule, even when minimal fracture growth is still occurring. This results in a significant waste of time and resources.

SUMMARY OF THE INVENTION

An embodiment described herein provides a method for adjusting a treatment schedule for a hydraulic fracturing operation to limit a pumping parameter (e.g., pump time, pump volume, and/or pump rate). The method includes analyzing fracture diagnostic data and/or fracture model data to estimate a pumping parameter at which a maximum number of hydraulic fractures will approximate a target fracture dimension during a hydraulic fracturing operation corresponding to a hydrocarbon well. The method also includes adjusting the treatment schedule for the hydraulic fracturing operation based on the estimated pumping parameter and then hydraulic fracturing the hydrocarbon well according to the adjusted treatment schedule.

Another embodiment described herein provides a second method for adjusting a treatment schedule for a hydraulic fracturing operation to limit a pumping parameter (e.g., pump time, pump volume, and/or pump rate). The method includes hydraulic fracturing stages of a treatment well to form corresponding treatment well fractures extending into a surrounding formation and, during the hydraulic fracturing of each stage of the treatment well, measuring (via a monitor well positioned in the same bench as the treatment well, an adjacent bench to the treatment well, or vertically through multiple benches within the vicinity of the treatment well) fracture diagnostic data that are indicative of fracture hits for the stage, where each fracture hit includes an interaction between one of the treatment well fractures and the monitor well. The method includes generating, based on the measured fracture diagnostic data, a graph including distances for the fracture hits versus a pumping parameter, where the pumping parameter includes a pump time, pump volume, and/or pump rate, and where the fracture hits correspond to treatment well fractures that approximate a target fracture dimension. The method also includes adjusting the treatment schedule for a hydraulic fracturing operation corresponding to a hydrocarbon well to limit the pumping parameter for the hydrocarbon well based on the generated graph, where the hydrocarbon well is located in the same bench, the adjacent bench, or a comparable bench as the treatment well and the monitor well. The method further includes hydraulic fracturing the hydrocarbon well according to the adjusted treatment schedule.

Another embodiment described herein provides a third method for adjusting a treatment schedule for a hydraulic fracturing operation to limit a pumping parameter (e.g., pump time, pump volume, and/or pump rate), including: generating, based on fracture diagnostic data and/or fracture model data, a graph including fracture hits versus distance, where the fracture hits correspond to hydraulic fractures that approximate a target fracture dimension. The method also includes hydraulic fracturing a stage of a hydrocarbon well to form hydraulic fractures extending into a surrounding formation and, during the hydraulic fracturing of the stage of the hydrocarbon well, measuring (via a monitor well positioned in the same bench as the hydrocarbon well, an adjacent bench to the hydrocarbon well, or vertically through multiple benches within the vicinity of the hydrocarbon well) a real-time pumping parameter including a number of fracture hits that approximate the target fracture dimension in real-time. The method further includes utilizing the generated graph to determine when the real-time pumping parameter is maximized, adjusting the treatment schedule for the hydraulic fracturing operation corresponding to the hydrocarbon well such that pumping of fracturing fluid will cease when the real-time pumping parameter is maximized, and hydraulic fracturing the hydrocarbon well according to the adjusted treatment schedule.

These and other features and attributes of the disclosed embodiments of the present techniques and their advantageous applications and/or uses will be apparent from the detailed description that follows.

BRIEF DESCRIPTION OF THE DRAWINGS

To assist those of ordinary skill in the relevant art in making and using the subject matter described herein, reference is made to the appended drawings, where.

Figure 1A:
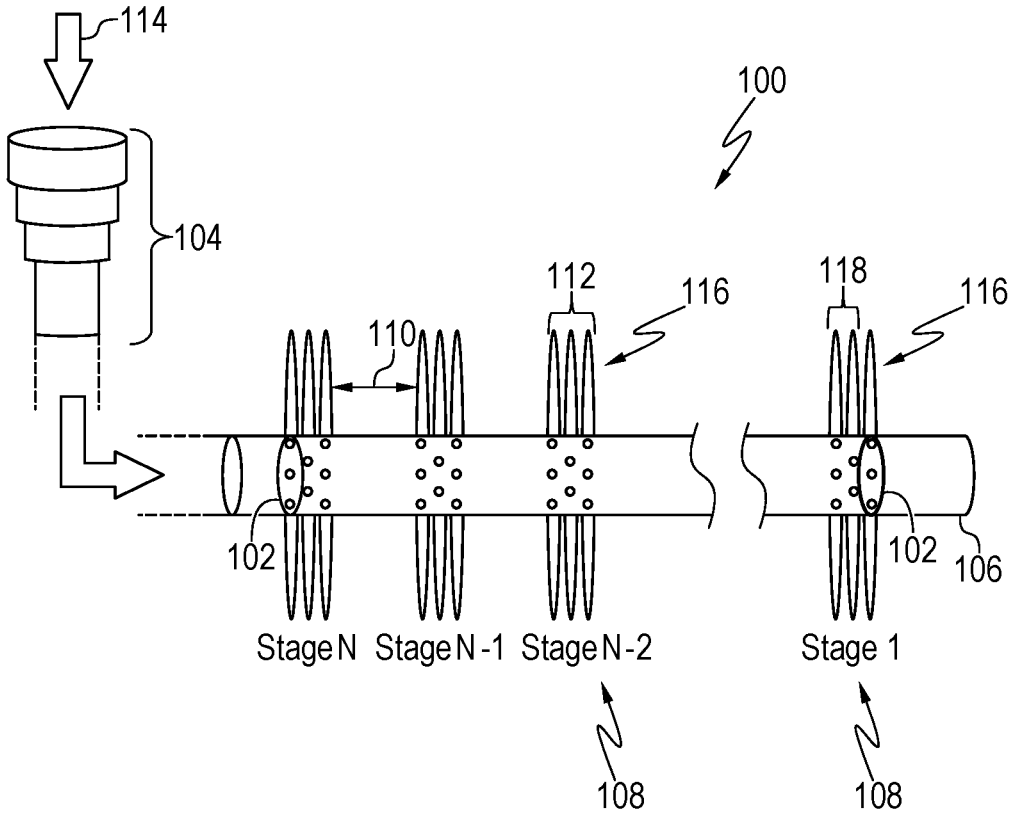
FIG. 1A (PRIOR ART)
FIG. 1A is a schematic view of a treatment well for an ideal case in which all the perforation clusters experience identical fracture growth.

It should be noted that the figures are merely examples of the present techniques and are not intended to impose limitations on the scope of the present techniques. Further, the figures are generally not drawn to scale, but are drafted for purposes of convenience and clarity in illustrating various aspects of the techniques.

DETAILED DESCRIPTION OF THE PREFERRED EMBODIMENTS

In the following detailed description section, the specific examples of the present techniques are described in connection with preferred embodiments. However, to the extent that the following description is specific to a particular embodiment or a particular use of the present techniques, this is intended to be for exemplary purposes only and simply provides a description of the embodiments. Accordingly, the techniques are not limited to the specific embodiments described below, but rather, include all alternatives, modifications, and equivalents falling within the true spirit and scope of the appended claims.

At the outset, and for case of reference, certain terms used in this application and their meanings as used in this context are set forth. To the extent a term used herein is not defined below, it should be given the broadest definition those skilled in the art have given that term as reflected in at least one printed publication or issued patent. Further, the present techniques are not limited by the usage of the terms shown below, as all equivalents, synonyms, new developments, and terms or techniques that serve the same or a similar purpose are considered to be within the scope of the present claims.

As used herein, the singular forms "a," "an," and "the" mean one or more when applied to any embodiment described herein. The use of "a," "an," and/or "the" does not limit the meaning to a single feature unless such a limit is specifically stated.

The term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "including," may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the term "any" means one, some, or all of a specified entity or group of entities, indiscriminately of the quantity.

The phrase "at least one," when used in reference to a list of one or more entities (or elements), should be understood to mean at least one entity selected from any one or more of the entities in the list of entities, but not necessarily including at least one of each and every entity specifically listed within the list of entities, and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently, "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" may mean A alone, B alone, C alone, A and B together, A and C together, B and C together, A, B, and C together, and optionally any of the above in combination with at least one other entity.

As used herein, the phrase "based on" does not mean "based only on," unless expressly specified otherwise. In other words, the phrase "based on" means "based only on," "based at least on," and/or "based at least in part on."

As used herein, the term "bench" refers to a target interval or section of a subsurface area that typically shares a substantial number of geologic properties, somewhat analogous to a geological formation.

As used herein, the terms "example," exemplary," and "embodiment," when used with reference to one or more components, features, structures, or methods according to the present techniques, are intended to convey that the described component, feature, structure, or method is an illustrative, non-exclusive example of components, features, structures, or methods according to the present techniques. Thus, the described component, feature, structure, or method is not intended to be limiting, required, or exclusive/exhaustive; and other components, features, structures, or methods, including structurally and/or functionally similar and/or equivalent components, features, structures, or methods, are also within the scope of the present techniques.

As used herein, the term "field" (sometimes referred to as an "oil and gas field" or a "hydrocarbon field") refers to an area including one or more hydrocarbon wells for which hydrocarbon production operations are to be performed to provide for the extraction of hydrocarbon fluids from a corresponding subterranean formation.

The term "fracture" (or "hydraulic fracture") refers to a crack or surface of breakage induced by an applied pressure or stress within a subterranean formation. Moreover, as described above, the term "wetted fracture" (or "wetted region" or "wetted hydraulic fracture") refers to an entire hydraulic fracture, while the term "propped fracture" (or "propped region" or "propped hydraulic fracture") refers to the region of the hydraulic fracture where proppant is present in enough quantity to prevent the closure of the hydraulic fracture. Furthermore, because the propped region of a fracture is the primary region of the fracture that contributes to the production of hydrocarbon fluids, in some cases, such region may also be referred to as the "productive region" and/or the "conductive region" of the fracture. Relatedly, the term "busted region" is used herein to refer to the non-propped region of the fracture that closes once the hydraulic pressure is released (i.e., the wetted region minus the propped region).

As used herein, the term "target fracture dimension" refers to a desired dimension for created hydraulic fractures, where such desired dimension is understood to be an approximate dimension rather than an exact dimension. Moreover, the specific dimension that is being measured may be prescribed by the location/position of the well and the corresponding fracture azimuth, which will vary depending on the details of the specific implementation. Thus, fracture height and fracture length may be considered as two special cases where the hydrocarbon well (or some portion thereof) is either horizontally or vertically aligned.

As used herein, the term "fracture hit" refer to the point at which an interaction occurs between two wells. For example, in the case of a monitor well (e.g., slant well) being utilized to measure fracture diagnostic data with respect to a treatment well, the fracture hits for each stage would be the time (or volume or some other suitable metric) at which the hydraulic fracture originating from the treatment well interacts with the monitor well in some manner, e.g., as detected via cross-well strain data, pressure data, or the like.

The term "hydraulic fracturing" refers to a process for creating fractures (also referred to as "hydraulic fractures") that extend from a wellbore into a reservoir, so as to stimulate the flow of hydrocarbon fluids from the reservoir into the wellbore. A fracturing fluid is generally injected into the reservoir with sufficient pressure to create and extend multiple fractures within the reservoir, and a proppant material is used to "prop" or hold open the fractures after the hydraulic pressure used to generate the fractures has been released.

As used herein, the term "maximum" is intended to denote an amount that is substantially or approximately maximized, with some variation from an absolute maximum expected due to some degree of inherent uncertainty.

As used herein, the term "monitor well" refers to any type of well that is utilized to measure fracture diagnostic data corresponding to one or more treatment wells according to embodiments described herein. In some embodiments, such monitor well may include a slant well that is configured to measure fracture diagnostic data (e.g., cross-well strain data and/or pressure data) from one or more treatment wells within the vicinity of the slant well (e.g., in the same bench, an adjacent bench, or a comparable bench).

The terms "substantial," "substantially," "approximate," and "approximately," when used in reference to a quantity or amount of a material, or a specific characteristic thereof, refers to an amount that is sufficient to provide an effect that the material or characteristic was intended to provide. The exact degree of deviation allowable may depend, in some cases, on the specific context.

As used herein, the term "surface" refers to the uppermost land surface of a land well, or the mud line of an offshore well, while the term "subsurface" (or "subterranean") generally refers to a geologic strata occurring below the earth's surface. Moreover, as used herein, "surface" and "subsurface" are relative terms. The fact that a particular piece of equipment is described as being on the surface does not necessarily mean it must be physically above the surface of the earth but, rather, describes only the relative placement of the surface and subsurface pieces of equipment. In that sense, the term "surface" may generally refer to any equipment that is located above the casing strings and other equipment that is located inside the wellbore. Moreover, according to embodiments described herein, the terms "downhole" and "subsurface" are sometimes used interchangeably, although the term "downhole" is generally used to refer specifically to the inside of the wellbore.

The term "wellbore" refers to a borehole drilled into a subterranean formation. The borehole may include vertical, deviated, highly deviated, and/or horizontal sections. The term "wellbore" also includes the downhole equipment associated with the borehole, such as the casing strings, production tubing, gas lift valves, and other subsurface equipment. Relatedly, the term "hydrocarbon well" (or simply "well") includes the wellbore in addition to the wellhead and other associated surface equipment.

The term "hydrocarbon well system" is used herein to refer to all the hydrocarbon wells and associated equipment within a particular field of interest. More specifically, according to embodiments described herein, a hydrocarbon well system includes at least one treatment well (with the corresponding wellhead, wellbore, and associated downhole and surface equipment) and at least one monitor well (with the corresponding wellhead, wellbore, and associated downhole and surface equipment). In addition, according to embodiments described herein, the hydrocarbon well system includes at least one computing system that enables the direction and execution of various hydrocarbon development tasks with respect to any of the wells within the field, including, for example, completion, stimulation, and production-related tasks.

Figure 1B:
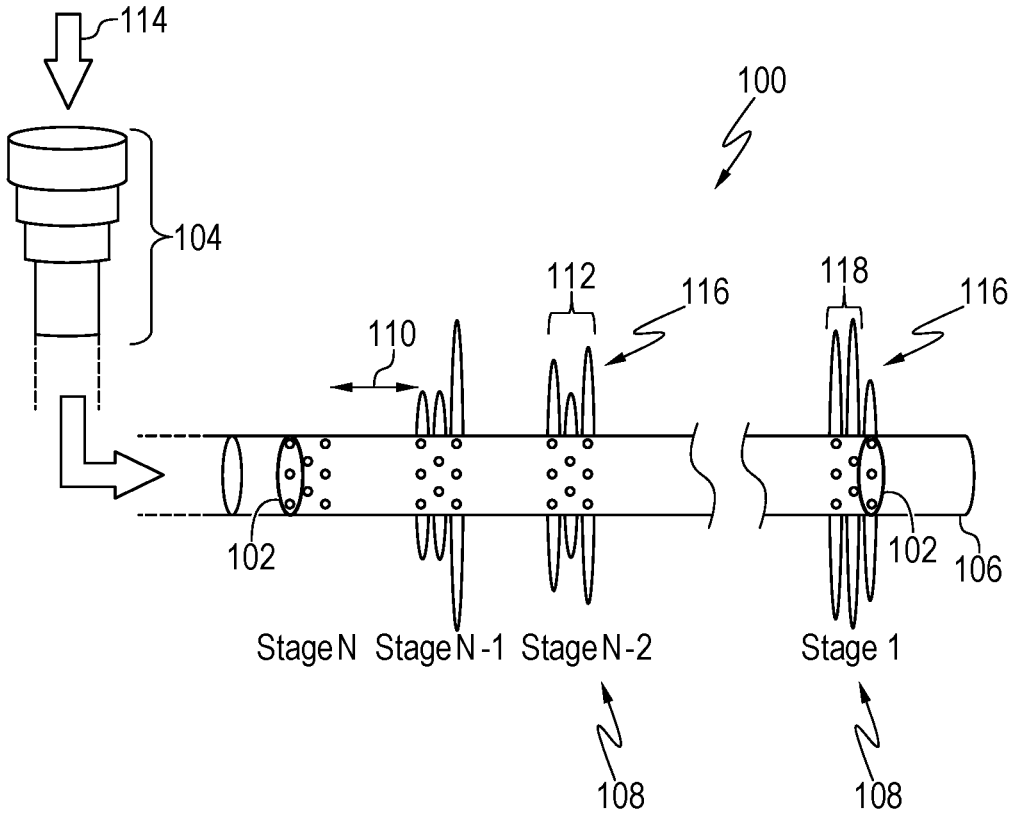
FIG. 1B (PRIOR ART)
FIG. 1B is a schematic view of the treatment well for a more realistic case in which the perforation clusters experience varying degrees of fracture growth.

Turning now to details of the present techniques, as described above, the treatment schedule for a hydraulic fracturing operation is predetermined, and the pump time is not adjusted based on the actual state of the fracture growth within the subsurface. This is illustrated by FIGS. 1A and 1B. In particular, FIG. 1A is a schematic view of a treatment well 100 for an ideal case in which all the perforation clusters 102 experience identical fracture growth, while FIG. 1B is a schematic view of the treatment well 100 for a more realistic case in which the perforation clusters 102 experience varying degrees of fracture growth. Both figures show a vertical wellbore section 104 and a horizontal wellbore section 106 including a number of individual stages 108 (e.g., Stage 1, . . . , Stage N−2, Stage N−1, and Stage N, as shown in FIGS. 1A and 1B), with a predetermined stage spacing 110 between each stage and each stage including a predetermined stage length 112. Each stage 108 also includes a number of perforation clusters 102 that are shot through the corresponding section of the wellbore casing. As described herein, during the hydraulic fracturing operation, pressurized fracturing fluid is pumped downhole, as indicated by arrow 114, creating hydraulic fractures 116 extending outwardly from the perforation clusters 102 and into the surrounding subsurface formation. Moreover, the hydraulic fractures 116 include a predetermined fracture spacing 118 that is based, at least in part, on the spacing between the perforation clusters within each stage 108.

Now turning to a comparison between FIGS. 1A and 1B, FIG. 1A is clearly the ideal case in which all the perforation clusters 102 within each stage 108 have produced hydraulic fractures 116 that grow together to reach their final, target fracture dimension (e.g., target fracture length). However, FIG. 1B is the less ideal (and more realistic) case in which the perforation clusters 102 have not all been stimulated equally and, as a result, the hydraulic fractures 116 in each stage 108 have not all grown at the same rate or to the same extent. In particular, some of the perforation clusters 102 have experienced faster fracture growth during the treatment (thus producing hydraulic fractures 116 that have reached the target fracture dimension), while other perforation clusters 102 have experienced slower fracture growth (thus producing hydraulic fractures 116 that have not reached the target fracture dimension). Moreover, some perforation clusters 102 have not experienced any fracture growth at all.

Figure 2:
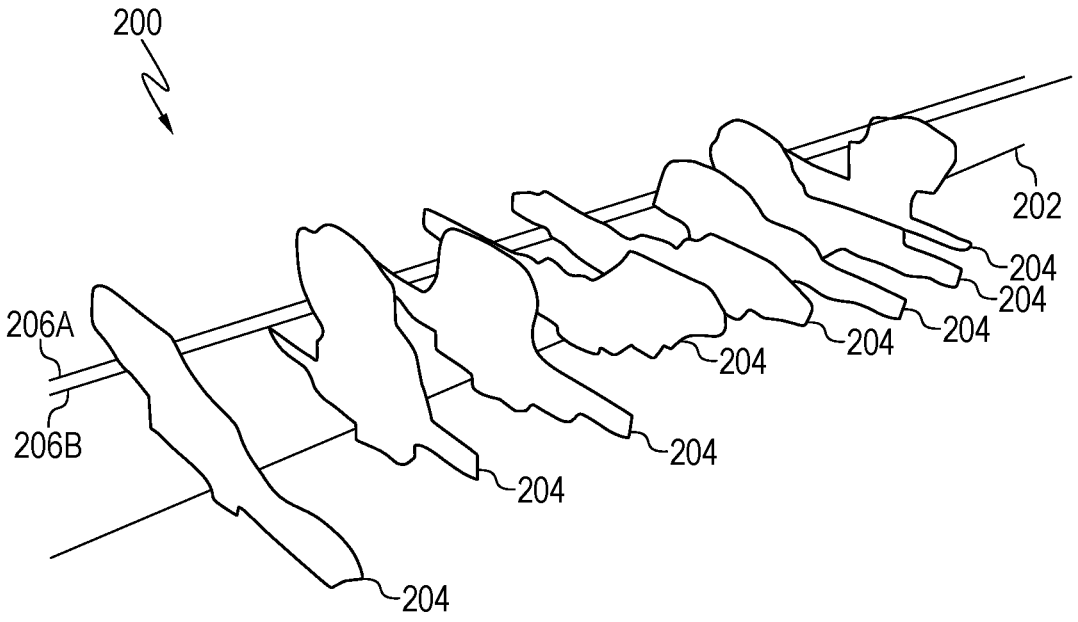
FIG. 2 (PRIOR ART)
FIG. 2 is a schematic view of a fracture model output for one stage of a treatment well that includes eight perforation clusters.

The more realistic case is further illustrated by FIG. 2, which is a schematic view of a fracture model output 200 for one stage of a treatment well 202 that includes eight perforation clusters. As depicted, some of the created hydraulic fractures 204 have grown to the extent of interacting with one or more of the two offset monitor wells 206A and 206B, while the other hydraulic fractures 204 have not.

As described above, this realistic case results in operational inefficiencies with respect to hydraulic fracturing operations since time and resources are wasted by pumping until the end of the preplanned treatment schedule, even when minimal or out of zone (horizontal or vertical) fracture growth is still occurring. Accordingly, the present techniques alleviate this difficulty and provide related advantages as well. In particular, the techniques described herein provide for the adjustment of treatment schedules for hydraulic fracturing operations to limit the pumping parameters, such as the pump time, pump volume, and/or pump rate. More specifically, the present techniques enable the pump time, pump volume, and/or pump rate to be limited based on an estimation of the point at which the maximum number of hydraulic fractures have reached the target fracture dimension during the pumping process. In various embodiments, this is achieved by using fracture diagnostic data and/or fracture model data (e.g., data generated using one or more fracture simulation models) to estimate the pump time, pump volume, and/or pump rate at which the first hydraulic fracture and the last hydraulic fracture will reach (or approximate) the desired fracture dimension (e.g., the target fracture length and/or fracture height) for a constant completion intensity within the bench (or vertically through several benches). Once the last expected hydraulic fracture has achieved its target fracture dimension, the pumps can be turned off, and preparation for the next stage can begin, saving both time and fracturing fluid.

In various embodiments, fracture diagnostic data are measured using any of various techniques. For example, in some embodiments, such fracture diagnostic data are measured from one or more monitor wells instrumented with one or more fiber optic cables and/or one or more pressure gauges. In such embodiments, such monitor well(s) may be used to measure fracture diagnostic data corresponding to one or more treatment wells that are undergoing a hydraulic fracturing operation, including data corresponding to the fracture hits for each stage (or some subset of such stages). Moreover, those skilled in the art will appreciate that, while embodiments are primarily described herein with respect to the utilization of cross-well strain data and/or pressure data, the fracture diagnostic data may additionally or alternatively include any other suitable type of data corresponding to a time, volume, or rate (or other suitable metric) at which a fracture hit occurs.

Figure 3A:
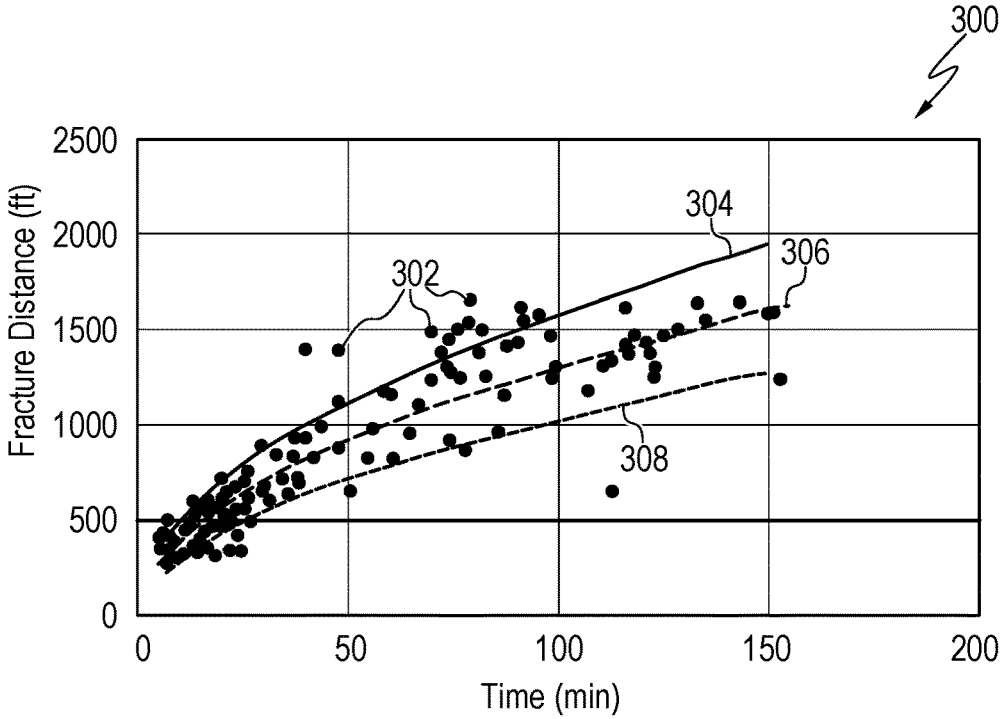
FIG. 3A is a graph illustrating the estimation of fracture distance versus pump time in accordance with the present techniques.

In various embodiments, the measured fracture diagnostic data track fracture length and/or fracture height versus pump time (or, alternatively, pump volume or pump rate), and one or more graphs may be generated based on the data. This is illustrated by FIG. 3A, which is a graph 300 illustrating the estimation of fracture distance (or fracture length) versus pump time in accordance with the present techniques. The graph 300 includes a number of fracture diagnostic datapoints 302 that were recorded by the fiber optic cable(s) within the monitor well. Moreover, a first curve 304 represents the first detected fracture hit, a second curve 306 represents the second detected fracture hit, and a third curve 308 represents the last detected fracture hit for a given distance.

Figure 3B:
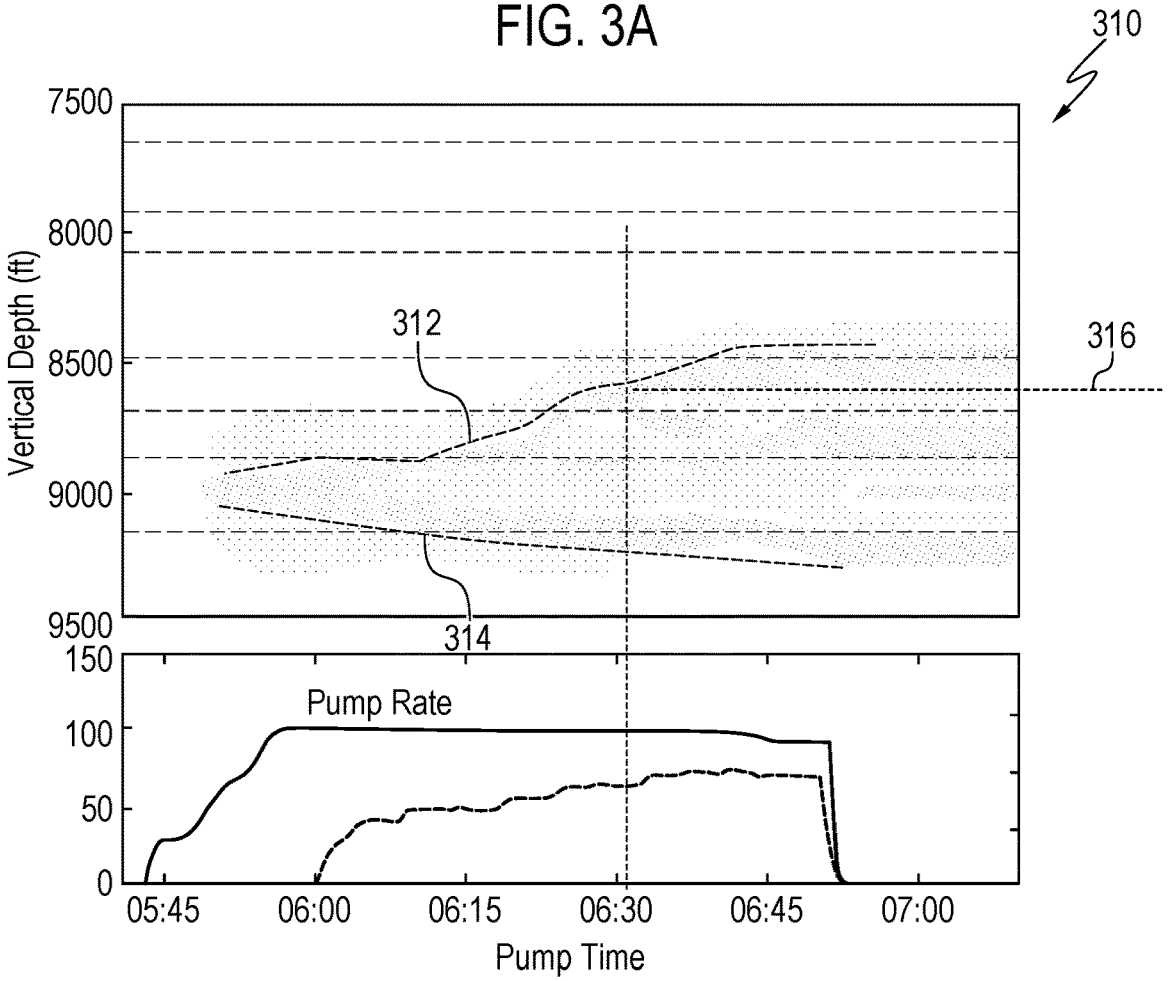
FIG. 3B is a graph illustrating the estimation of vertical depth versus pump time in accordance with the present techniques.

Similarly, FIG. 3B is a graph 310 illustrating the estimation of vertical depth (or fracture height) versus pump time in accordance with the present techniques. In particular, the graph 310 represents the case of a vertical monitor well that is used to control fracture height growth by limiting pump time and/or pump rate according to an estimation of the top of the hydraulic fracture, as represented by line 312, and the bottom of the hydraulic fracture, as represented by line 314. As an example, if further fracture height growth is not desired after point 316 in the graph 310, pumping may be ceased and/or the pump rate may be reduced at the corresponding pump time shown in the graph 310.

In various embodiments, the resulting graph(s) are then applied as the expected fracture behavior for one or more other hydrocarbon wells that are within the vicinity of the monitor and treatment wells. For example, the well(s) (or some subset thereof) may be located in the same bench as the monitor and treatment wells, or the well(s) (or some subset thereof) may be located in one or more adjacent benches. Moreover, in some embodiments, the graph(s) may be applied to one or more other hydrocarbon wells that are located in one or more comparable benches, where the term "comparable bench" generally refers to a bench including mineralogical properties and geophysical properties that approximately align with the bench of the monitor and treatment wells. Moreover, for the case in which the monitor and treatment wells are drilled vertically through multiple benches, the well(s) (or some subset thereof) may be located vertically through multiple similar benches.

In such embodiments, applying the generated graph(s) to a hydrocarbon well includes adjusting the treatment schedule for such well to limit the pump time, pump volume, and/or pump rate based on the target fracture dimension and the expected fracture behavior as represented by the graph(s). In particular, the graph(s) may be used to estimate the pump time, pump volume, and/or pump rate at which the last hydraulic fracture in a stage is expected to reach the target fracture dimension. As a specific example, for a target fracture length of 1000 feet, the generated graph(s) may be used to determine that the first hydraulic fracture is expected to arrive at 40 minutes, and the last hydraulic fracture is expected to arrive at 100 minutes. If the treatment schedule was initially designed to last 150 minutes and the fracturing fluid is to be pumped at 100 barrels per minute (bpm), turning the pumps off at 100 minutes would save 50 minutes of pump time and 5,000 barrels of fracturing fluid. Moreover, the generated graph(s) may be used to determine that any perforation clusters that did not result in a fracture hit represent either no fracture initiation or suppressed fracture growth. As a result, the limitation of the pump time, pump volume, and/or pump rate provides an optimization of the treatment schedule that saves both time and resources.

In some embodiments, a monitor well and treatment well pair may be used, in combination with the generated graph(s), to adjust the treatment schedule for the treatment well. In particular, the fracture diagnostic data measured by the monitor well may provide for the real-time determination of the pump time, pump volume, and/or pump rate at which the first fracture hit occurs. The generated graph(s) may then be used to estimate the pump time, pump volume, and/or pump rate at which the last fracture hit will occur, and the treatment schedule may be adjusted accordingly.

In some embodiments, the measured fracture diagnostic data track fracture hits by distance, and one or more graphs are generated based on the data. The generated graph(s) may then be used, in combination with a monitor well instrumented with fiber optic cables, for example, to determine when each hydraulic fracture originating from the treatment well arrives and the number of fracture hits that have occurred. This information may then be compared to the graph(s) to determine the expected number of fracture hits. The treatment schedule may then be adjusted such that pumping is terminated (or, alternatively, the pump rate is decreased) when the number of fracture hits matches the expected number of fracture hits.

Figure 4:
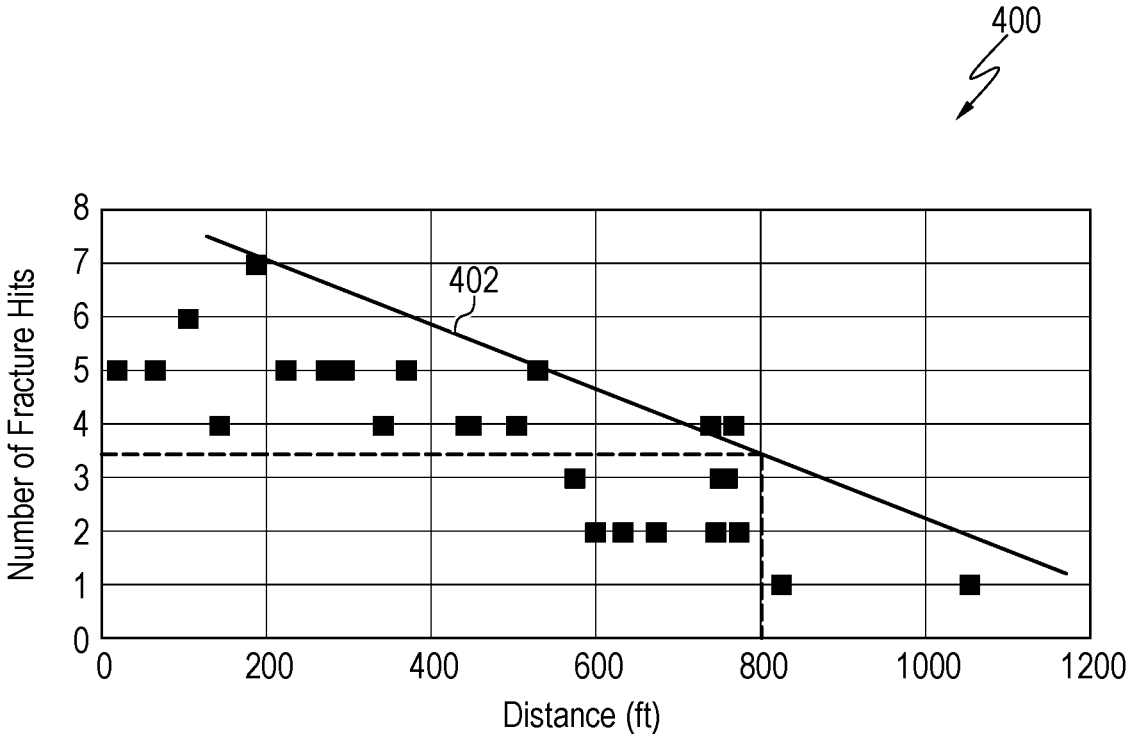
FIG. 4 is a graph illustrating the estimation of the expected number of fracture hits per stage in accordance with the present techniques.

This is illustrated by FIG. 4, which is a graph 400 illustrating the estimation of the expected number of fracture hits per stage in accordance with the present techniques. Specifically, for the exemplary embodiment shown in the graph 400, the curve 402 plots the number of fracture hits that are expected for a target fracture length of 800 feet. In particular, as shown, three to four hydraulic fractures with a length of around 800 feet are expected per stage. Therefore, using this approach, the monitor well may be used to count the number of fracture hits in real-time, and the pumping process may be terminated once three or four fracture hits are tallied. This advantageously saves both time and resources since further pumping is not likely to increase the number of fracture hits of the desired fracture length.

Furthermore, in other embodiments, fracture model data generated using one or more fracture models, such as, for example, one or more fracture simulation models, are used instead of (or in addition to) the fracture diagnostic data described above. In such embodiments, the initial data measurement step may optionally be omitted, and the fracture model(s) may be used to provide a direct estimation of fracture hit distance and/or vertical depth versus pump time (or pump volume or pump rate) and/or the expected number of fracture hits per stage, depending on the details of the particular implementation. Moreover, in some embodiments, one or more fracture simulation models calibrated using fracture diagnostic data corresponding to particular stage designs are utilized to generate one or more graphs corresponding to other stage designs.

In various embodiments, the present techniques may be performed prior to a hydraulic fracturing operation, i.e., to make adjustments to the treatment schedule prior to beginning the pumping process. Alternatively, the present techniques may be performed in real-time during the hydraulic fracturing process, i.e., to make real-time adjustments to the treatment schedule.

The present techniques provide various advantages over conventional hydraulic fracturing techniques. As an example, the present techniques reduce the amount of time needed to perform the hydraulic fracturing operation by reducing the pump time. As another example, the present techniques save resources by reducing the amount of fracturing fluid and proppant that is used to perform the hydraulic fracturing operation. This advantage also includes related environmental benefits since lower fracturing fluid and proppant usage is desirable from an environmental standpoint. As another example, the present techniques can be used to provide real-time information regarding the hydraulic fracturing operation, enabling the operator to make informed decisions regarding the overall process.

Figure 5:
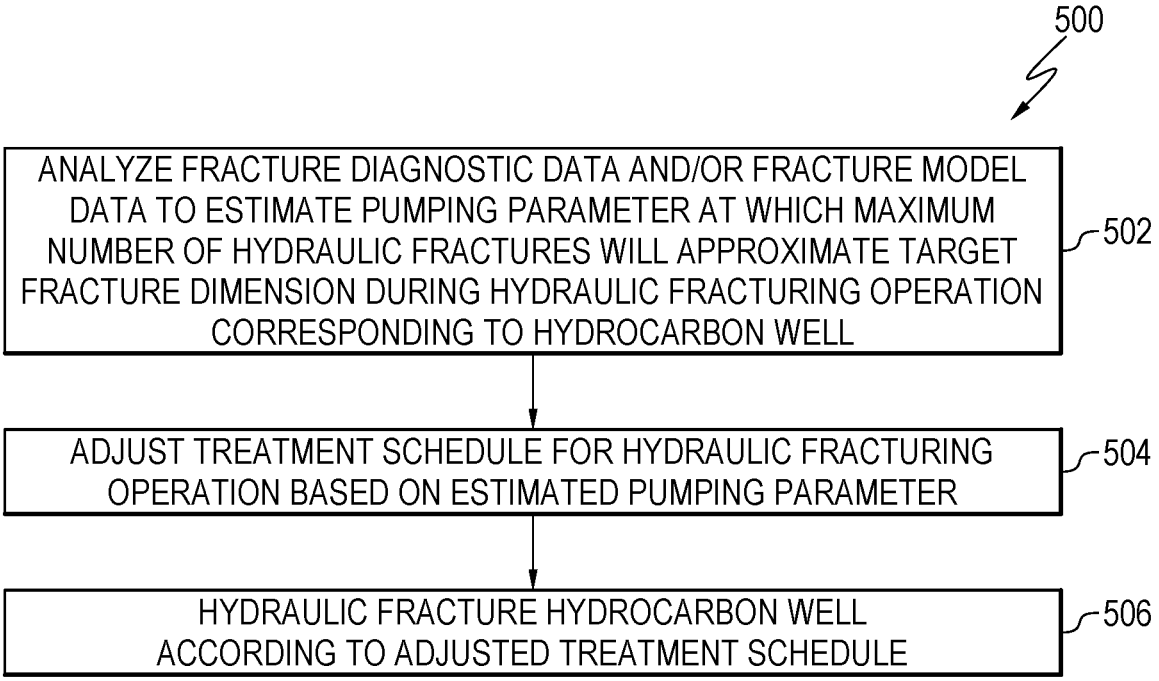
FIG. 5 is a process flow diagram of an exemplary method for adjusting a treatment schedule for a hydraulic fracturing operation to limit pump time, pump volume, and/or pump rate in accordance with the present techniques.
Figure 6:
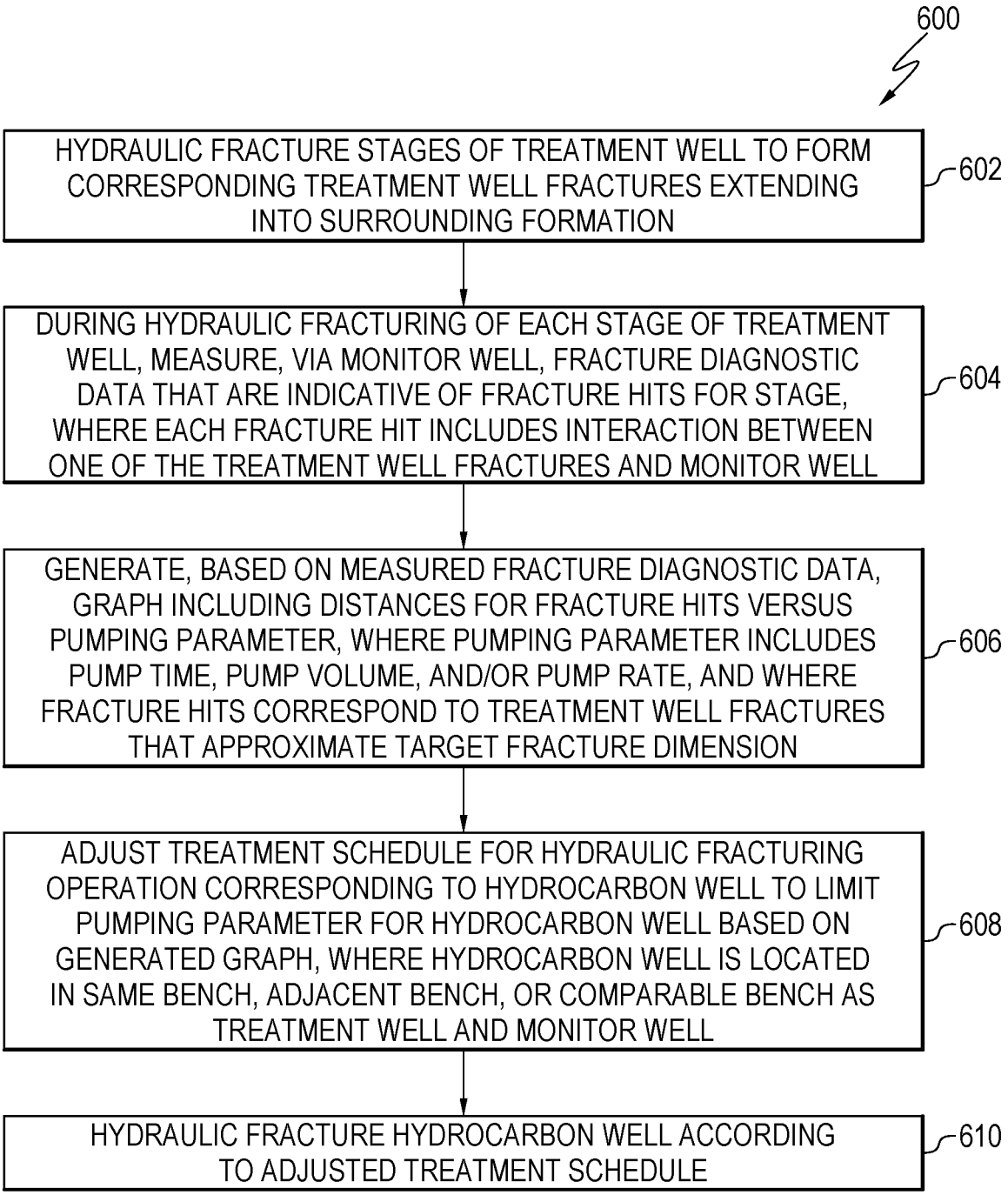
FIG. 6 is a process flow diagram of another exemplary method for adjusting a treatment schedule for a hydraulic fracturing operation to limit pump time, pump volume, and/or pump rate in accordance with the present techniques.
Figure 7:
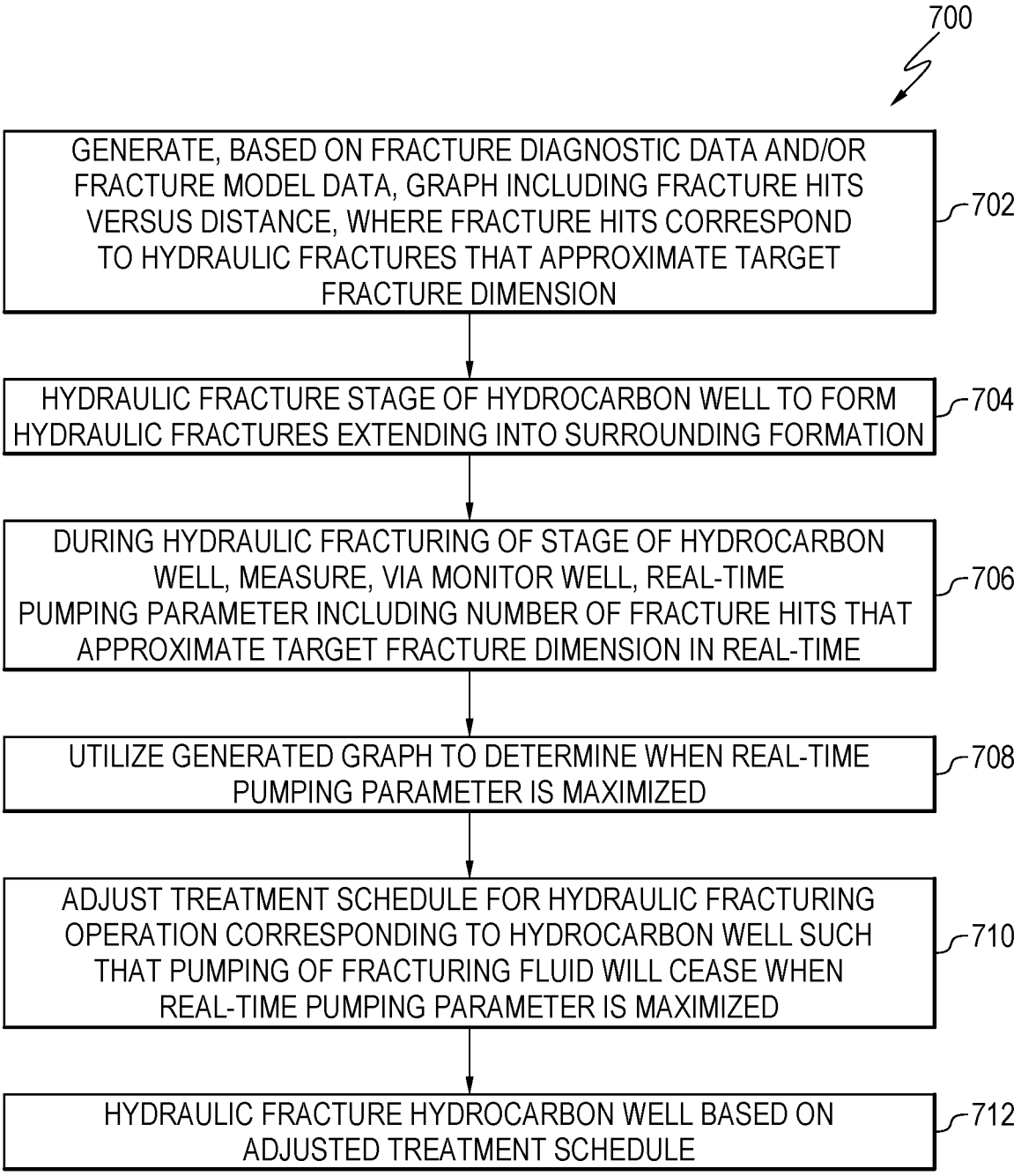
FIG. 7 is a process flow diagram of another exemplary method for adjusting a treatment schedule for a hydraulic fracturing operation to limit pump time, pump volume, and/or pump rate in accordance with the present techniques.

FIGS. 5, 6, and 7 are schematic views of exemplary embodiments of methods 500, 600, and 700 for adjusting treatment schedules for hydraulic fracturing operations to limit pump time, pump volume, and/or pump rate in accordance with the present techniques. Each of the methods 500, 600, and 700 may be executed, in part, by one or more computing systems including one or more processors, such as the exemplary cluster computing system described with respect to FIG. 8 (or any suitable variation(s) thereof). In some embodiments, such computing system(s) are positioned at the hydrocarbon field at which the relevant wells are located and form part of the overall hydrocarbon well system. For example, the computing system(s) may form part of a mobile command center for directing the operations performed with respect to such wells.

Turning first to FIG. 5, the exemplary method 500 begins at block 502, at which fracture diagnostic data and/or fracture model data are analyzed to estimate a pumping parameter (e.g., the pump time, pump volume, and/or pump rate) at which a maximum number of hydraulic fractures will approximate a target fracture dimension (e.g., a target fracture length and/or height) during a hydraulic fracturing operation corresponding to a hydrocarbon well. In some embodiments, the method 500 also includes generating the fracture model data by running one or more fracture models, such as one or more fracture simulation models. Additionally or alternatively, in some embodiments, the method 500 includes hydraulic fracturing stages of a treatment well and, during the hydraulic fracturing of each stage of the treatment well, measuring the fracture diagnostic data via a monitor well that is positioned in the same bench as the treatment well, an adjacent bench to the treatment well, or vertically through multiple benches within the vicinity of the treatment well. In some embodiments, the fracture diagnostic data include cross-well strain (CWS) data, and the method 500 includes measuring the CWS data via one or more fiber optic cable that are deployed within the wellbore of the monitor well. In some embodiments, the fracture diagnostic data include pressure data, and the method 500 includes coupling one or more pressure receivers to the wellbore of the monitor well to provide for the measurement of the pressure data.

In various embodiments, the method 500 includes estimating the pumping parameter by generating, based on the fracture diagnostic data and/or the fracture model data, a graph including fracture hit distance and/or fracture height versus the pumping parameter and then estimating the pumping parameter at which the maximum number of hydraulic fractures will approximate the target fracture dimension based on the generated graph.

In various embodiments, the hydrocarbon well comprises a treatment well. In such embodiments, the method 500 includes hydraulic fracturing a stage of the hydrocarbon well and, during the hydraulic fracturing of the stage of the hydrocarbon well, estimating the pumping parameter in real-time via a monitor well positioned in the same bench as the hydrocarbon well, an adjacent bench to the hydrocarbon well, or vertically through multiple benches within the vicinity of the hydrocarbon well.

In various embodiments, the method 500 includes generating, based on the fracture diagnostic data and/or the fracture model data, a graph including fracture hits versus distance and commencing hydraulic fracturing of a stage of the hydrocarbon well to form hydraulic fractures extending into a surrounding formation. In such embodiments, during the hydraulic fracturing of the stage of the hydrocarbon well, measuring, via a monitor well positioned in the same bench as the hydrocarbon well, an adjacent bench to the hydrocarbon well, or vertically through multiple benches within the vicinity of the hydrocarbon well, a second pumping parameter including the number of fracture hits that approximate the target fracture dimension in real-time. Moreover, in such embodiments, the generated graph is utilized to determine when the second pumping parameter is maximized, and the treatment schedule for the hydraulic fracturing operation corresponding to the hydrocarbon well is adjusted by ceasing pumping when the second pumping parameter is maximized.

At block 504, the treatment schedule for the hydraulic fracturing operation is adjusted based on the estimated pumping parameter. In various embodiments, this includes limiting the pump parameter (i.e., the pump time, the pump volume, and/or the pump rate) based on the estimated pumping parameter such that less time and/or less fracturing fluid is to be utilized for the hydraulic fracturing operation.

At block 506, the hydrocarbon well is hydraulic fractured according to the adjusted treatment schedule. In various embodiments, the method 500 is to be executed for each stage of the hydrocarbon well (or some subset of such stages) such that the treatment schedule is modified based on the conditions for each stage.

With respect to FIG. 6, the exemplary method 600 begins at block 602, at which stages of a treatment well are hydraulic fractured to form corresponding treatment well fractures extending into the surrounding formation. At block 604, during the hydraulic fracturing of each stage of the treatment well, fracture diagnostic data that are indicative of fracture hits for the stage are measured via a monitor well positioned in the same bench as the treatment well, an adjacent bench to the treatment well, or vertically through multiple benches within the vicinity of the treatment well, where each fracture hit includes an interaction between one of the treatment well fractures and the monitor well.

At block 606, a graph including distances for the fracture hits versus a pumping parameter is generated based on the measured fracture diagnostic data. The pumping parameter includes a pump time, pump volume, and/or pump rate, and the fracture hits correspond to treatment well fractures that approximate a target fracture dimension.

At block 608, the treatment schedule for a hydraulic fracturing operation corresponding to a hydrocarbon well is adjusted to limit the pumping parameter for the hydrocarbon well based on the generated graph, where the hydrocarbon well is located in the same bench, the adjacent bench, or a comparable bench as the treatment well and the monitor well. At block 610, the hydrocarbon well is hydraulic fractured according to the adjusted treatment schedule.

In some embodiments, the hydrocarbon well includes a second treatment well. In such embodiments, the method 600 may also include hydraulic fracturing a stage of the hydrocarbon well and, during the hydraulic fracturing of the stage of the hydrocarbon well, measuring, via a second monitor well positioned in the same bench as the hydrocarbon well, an adjacent bench to the hydrocarbon well, or vertically through multiple benches within the vicinity of the hydrocarbon well, a real-time pumping parameter, where the real-time pumping parameter includes a pump time, pump volume, or pump rate at which a first fracture hit that approximates the target fracture dimension occurs in real-time. In such embodiments, the adjustment of the treatment schedule for the stage of the hydrocarbon well may be performed to limit the pumping parameter based on both the generated graph and the measured real-time pumping parameter. Moreover, in some embodiments, this is accomplished by estimating a second real-time pumping parameter, where the second real-time pumping parameter includes a second pump time, second pump volume, and/or second pump rate at which a last fracture hit that approximates the target fracture dimension is expected to occur and then adjusting the treatment schedule for the stage such that the pumping parameter is limited to the second real-time pumping parameter.

Turning now to FIG. 7, the exemplary method 700 begins at block 702, at which a graph including fracture hits versus distance is generated based on the fracture diagnostic data and/or the fracture model data, where the fracture hits correspond to hydraulic fractures that approximate a target fracture dimension.

At block 704, a stage of a hydrocarbon well is hydraulic fractured to form hydraulic fractures extending into the surrounding formation. At block 706, during the hydraulic fracturing of the stage of the hydrocarbon well, a real-time pumping parameter is measured via a monitor well positioned in the same bench as the hydrocarbon well, an adjacent bench to the hydrocarbon well, or vertically through multiple benches within the vicinity of the hydrocarbon well, where the real-time pumping parameter includes the number of fracture hits that approximate the target fracture dimension in real-time. At block 708, the generated graph is utilized to determine when the real-time pumping parameter is maximized.

At block 710, the treatment schedule for the hydraulic fracturing operation corresponding to the hydrocarbon well is adjusted such that the pumping of fracturing fluid will cease when the real-time pumping parameter is maximized. At block 710, the hydrocarbon well is hydraulic fractured according to the adjusted treatment schedule.

Those skilled in the art will appreciate that the exemplary methods 500, 600, and 700 of FIGS. 5, 6, and 7, respectively, are susceptible to modification without altering the technical effect provided by the present techniques. In practice, the exact manner in which the method 500, 600, and/or 700 is implemented will depend, at least in part, on the details of the specific implementation. For example, in some embodiments, some of the blocks shown in FIGS. 5, 6, and/or 7 may be altered or omitted from the method 500, 600, and/or 700, respectively, and/or new blocks may be added to the method 500, 600, and/or 700, respectively, without departing from the scope of the present techniques.

Figure 8:
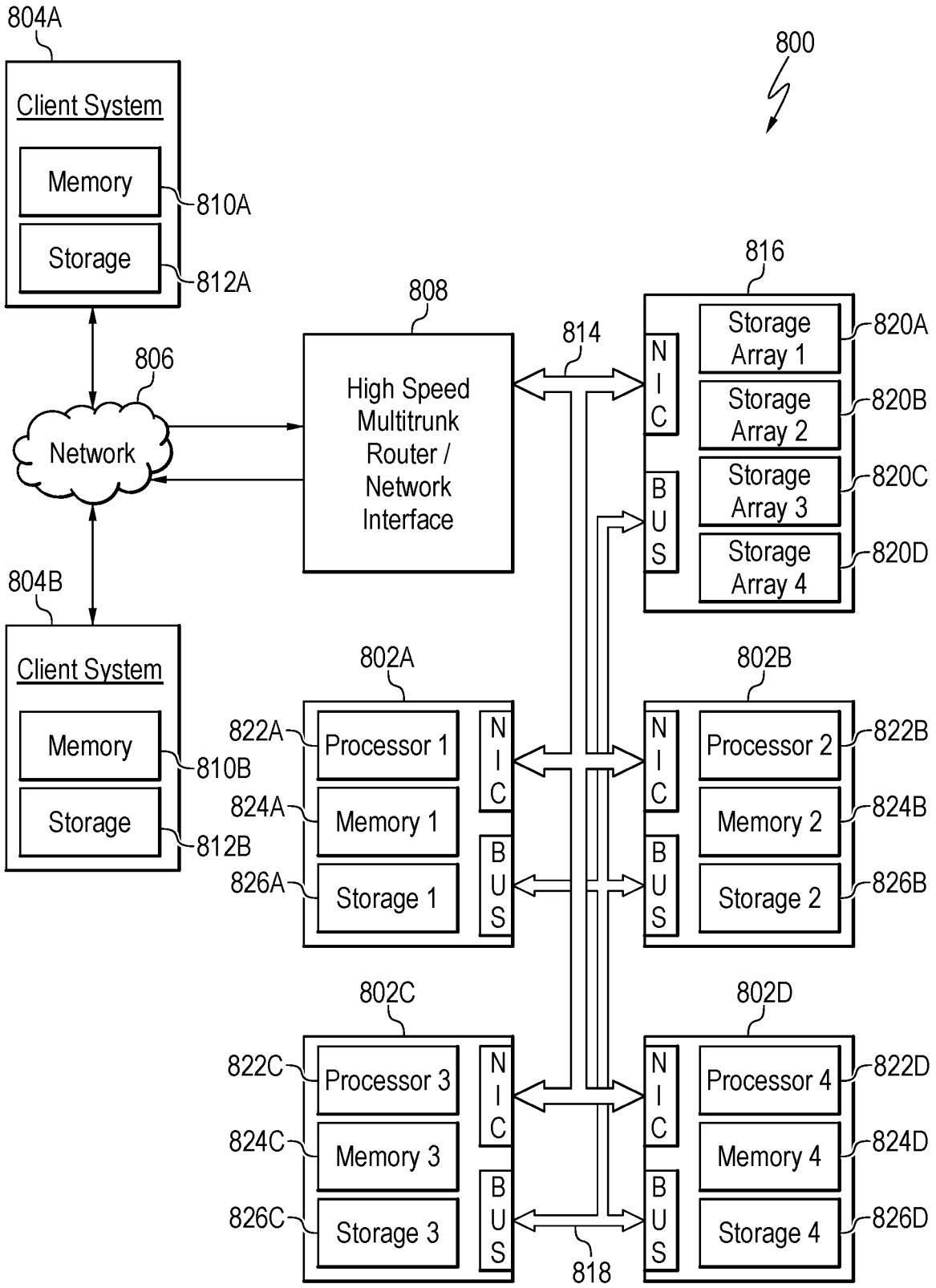
FIG. 8 is a block diagram of an exemplary cluster computing system that may be utilized to implement at least a portion of the present techniques.

FIG. 8 is a block diagram of an exemplary cluster computing system 800 that may be utilized to implement at least a portion of the present techniques. The exemplary cluster computing system 800 shown in FIG. 8 has four computing units 802A, 802B, 802C, and 802D, each of which may perform calculations for a portion of the present techniques. However, one of ordinary skill in the art will recognize that the cluster computing system 800 is not limited to this configuration, as any number of computing configurations may be selected. For example, a smaller analysis may be run on a single computing unit, such as a workstation, while a large calculation may be run on a cluster computing system 800 having tens, hundreds, or even more computing units.

The cluster computing system 800 may be accessed from any number of client systems 804A and 804B over a network 806, for example, through a high-speed network interface 808. The computing units 802A to 802D may also function as client systems, providing both local computing support and access to the wider cluster computing system 800.

The network 806 may include a local area network (LAN), a wide area network (WAN), the Internet, or any combinations thereof. Each client system 804A and 804B may include one or more non-transitory, computer-readable storage media for storing the operating code and program instructions that are used to implement at least a portion of the present techniques, as described further with respect to the non-transitory, computer-readable storage media of FIG. 9. For example, each client system 804A and 804B may include a memory device 810A and 810B, which may include random access memory (RAM), read only memory (ROM), and the like. Each client system 804A and 804B may also include a storage device 812A and 812B, which may include any number of hard drives, optical drives, flash drives, or the like.

The high-speed network interface 808 may be coupled to one or more buses in the cluster computing system 800, such as a communications bus 814. The communication bus 814 may be used to communicate instructions and data from the high-speed network interface 808 to a cluster storage system 816 and to each of the computing units 802A to 802D in the cluster computing system 800. The communications bus 814 may also be used for communications among the computing units 802A to 802D and the cluster storage system 816. In addition to the communications bus 814, a high-speed bus 818 can be present to increase the communications rate between the computing units 802A to 802D and/or the cluster storage system 816.

In some embodiments, the one or more non-transitory, computer-readable storage media of the cluster storage system 816 include storage arrays 820A, 820B, 820C and 820D for the storage of models, data. visual representations, results (such as graphs, charts, and the like used to convey results obtained using the present techniques), code, and other information concerning the implementation of at least a portion of the present techniques. The storage arrays 820A to 820D may include any combinations of hard drives, optical drives, flash drives, or the like.

Each computing unit 802A to 802D includes at least one processor 822A, 822B, 822C and 822D and associated local non-transitory, computer-readable storage media, such as a memory device 824A, 824B, 824C and 824D and a storage device 826A, 826B, 826C and 826D, for example. Each processor 822A to 822D may be a multiple core unit, such as a multiple core central processing unit (CPU) or a graphics processing unit (GPU). Each memory device 824A to 824D may include ROM and/or RAM used to store program instructions for directing the corresponding processor 822A to 822D to implement at least a portion of the present techniques. Each storage device 826A to 826D may include one or more hard drives, optical drives, flash drives, or the like. In addition, each storage device 826A to 826D may be used to provide storage for models, intermediate results, data, images, or code used to implement at least a portion of the present techniques.

The present techniques are not limited to the architecture or unit configuration illustrated in FIG. 8. For example, any suitable processor-based device may be utilized for implementing at least a portion of the embodiments described herein, including (without limitation) personal computers, laptop computers, computer workstations, mobile devices, and multi-processor servers or workstations with (or without) shared memory. Moreover, the embodiments described herein may be implemented, at least in part, on application specific integrated circuits (ASICs) or very-large-scale integrated (VLSI) circuits. In fact, those skilled in the art may utilize any number of suitable structures capable of executing logical operations according to the embodiments described herein.

Figure 9:
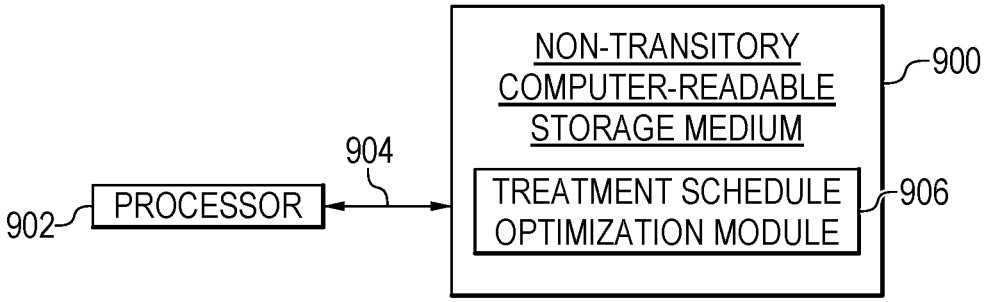
FIG. 9 is a block diagram of an exemplary non-transitory, computer-readable storage medium that may be used for the storage of data and modules of program instructions for implementing at least a portion of the present techniques.

FIG. 9 is a block diagram of an exemplary non-transitory, computer-readable storage medium 900 that may be used for the storage of data and modules of program instructions for implementing at least a portion of the present techniques. The non-transitory, computer-readable storage medium 900 may include a memory device, a hard disk, and/or any number of other devices, as described herein. A processor 902 may access the non-transitory, computer-readable storage medium 900 over a bus or network 904. While the non-transitory, computer-readable storage medium 900 may include any number of modules for implementing the present techniques, in some embodiments, the non-transitory, computer-readable storage medium 900 includes a treatment schedule optimization module 906 for performing the techniques described herein (and/or any suitable variations thereof).

In one or more embodiments, the present techniques may be susceptible to various modifications and alternative forms, such as the following embodiments as noted in paragraphs 1 to 20:

1. A method for adjusting a treatment schedule for a hydraulic fracturing operation to limit at least one of a pump time, a pump volume, or a pump rate, including: analyzing at least one of fracture diagnostic data or fracture model data to estimate a pumping parameter at which a maximum number of hydraulic fractures will approximate a target fracture dimension during a hydraulic fracturing operation corresponding to a hydrocarbon well; adjusting a treatment schedule for the hydraulic fracturing operation based on the estimated pumping parameter; and hydraulic fracturing the hydrocarbon well according to the adjusted treatment schedule.
2. The method of paragraph 1, where the target fracture dimension includes at least one of a target fracture length or a target fracture height.
3. The method of paragraph 1 or 2, where the estimated pumping parameter includes at least one of a pump time, a pump volume, or a pump rate, and where the method includes estimating the pumping parameter by: generating, based on the at least one of the fracture diagnostic data or the fracture model data, a graph including at least one of fracture hit distance or fracture height versus the pumping parameter; and estimating the pumping parameter at which the maximum number of hydraulic fractures will approximate the target fracture dimension based on the generated graph.
4. The method of any of paragraphs 1 to 3, where the estimated pumping parameter includes at least one of a pump time, a pump volume, or a pump rate, where the hydrocarbon well includes a treatment well, and where the method further includes: hydraulic fracturing a stage of the hydrocarbon well; and during the hydraulic fracturing of the stage of the hydrocarbon well, estimating the pumping parameter in real-time via a monitor well positioned in a same bench as the hydrocarbon well, an adjacent bench to the hydrocarbon well, or vertically through multiple benches within a vicinity of the hydrocarbon well.
5. The method of any of paragraphs 1 to 4, where the estimated pumping parameter includes at least one of a pump time or a pump volume, and where the method includes: generating, based on the at least one of the fracture diagnostic data or the fracture model data, a graph including fracture hits versus distance; commencing hydraulic fracturing of a stage of the hydrocarbon well to form hydraulic fractures extending into a surrounding formation; and during the hydraulic fracturing of the stage of the hydrocarbon well, measuring, via a monitor well positioned in a same bench as the hydrocarbon well, an adjacent bench to the hydrocarbon well, or vertically through multiple benches within a vicinity of the hydrocarbon well, a second pumping parameter including a number of fracture hits that approximate the target fracture dimension in real-time; utilizing the generated graph to determine when the second pumping parameter is maximized; and adjusting the treatment schedule for the hydraulic fracturing operation corresponding to the hydrocarbon well by ceasing pumping when the second pumping parameter is maximized.
6. The method of any of paragraphs 1 to 5, including generating the fracture model data by running a fracture simulation model.
7. The method of any of paragraphs 1 to 6, including: hydraulic fracturing stages of a treatment well; and during the hydraulic fracturing of each stage of the treatment well, measuring the fracture diagnostic data via a monitor well positioned in a same bench as the treatment well, an adjacent bench to the treatment well, or vertically through multiple benches within a vicinity of the treatment well.
8. The method of paragraph 7, where the fracture diagnostic data include CWS data, and where the method further includes measuring the CWS data via at least one fiber optic cable that is deployed within a wellbore of the monitor well.
9. The method of any of paragraphs 1 to 8, where the fracture diagnostic data include pressure data, and where the method further includes coupling at least one pressure receiver to a wellbore of the monitor well to provide for the measurement of the pressure data.
10. A method for adjusting a treatment schedule for a hydraulic fracturing operation to limit at least one of a pump time, a pump volume, or a pump rate, including: hydraulic fracturing stages of a treatment well to form corresponding treatment well fractures extending into a surrounding formation; during the hydraulic fracturing of each stage of the treatment well, measuring, via a monitor well positioned in a same bench as the treatment well, an adjacent bench to the treatment well, or vertically through multiple benches within a vicinity of the treatment well, fracture diagnostic data that are indicative of fracture hits for the stage, where each fracture hit includes an interaction between one of the treatment well fractures and the monitor well; generating, based on the measured fracture diagnostic data, a graph including distances for the fracture hits versus a pumping parameter, where the pumping parameter includes at least one of a pump time or a pump volume, and where the fracture hits correspond to treatment well fractures that approximate a target fracture dimension; adjusting a treatment schedule for a hydraulic fracturing operation corresponding to a hydrocarbon well to limit the pumping parameter for the hydrocarbon well based on the generated graph, where the hydrocarbon well is located in the same bench, the adjacent bench, or a comparable bench as the treatment well and the monitor well; and hydraulic fracturing the hydrocarbon well according to the adjusted treatment schedule.

11. The method of paragraph 10, where the hydrocarbon well includes a second treatment well, and where the method further includes: hydraulic fracturing a stage of the hydrocarbon well; and during the hydraulic fracturing of the stage of the hydrocarbon well, measuring, via a second monitor well positioned in a same bench as the hydrocarbon well, an adjacent bench to the hydrocarbon well, or vertically through multiple benches within a vicinity of the hydrocarbon well, a real-time pumping parameter, where the real-time pumping parameter includes at least one of a pump time or a pump volume at which a first fracture hit that approximates the target fracture dimension occurs in real-time; where the adjustment of the treatment schedule for the stage of the hydrocarbon well is performed to limit the pumping parameter based on both the generated graph and the measured real-time pumping parameter.

12. The method of paragraph 11, where the limitation of the pumping parameter based on both the generated graph and the measured real-time pumping parameter includes: estimating a second real-time pumping parameter, where the second real-time pumping parameter includes a second pump time or a second pump volume at which a last fracture hit that approximates the target fracture dimension is expected to occur; and adjusting the treatment schedule for the stage such that the pumping parameter is limited to the second real-time pumping parameter.

13. The method of any of paragraphs 10 to 12, where the fracture diagnostic data include CWS data, and where the method further includes deploying at least one fiber optic cable within a wellbore of the monitor well to provide for the measurement of the CWS data.

14. The method of any of paragraphs 10 to 13, where the fracture diagnostic data include pressure data, and where the method further includes coupling at least one pressure receiver to a wellbore of the monitor well to provide for the measurement of the pressure data.

15. The method of any of paragraphs 10 to 14, where the target fracture dimension includes at least one of a target fracture length or a target fracture height.

16. A method for adjusting a treatment schedule for a hydraulic fracturing operation to limit at least one of a pump time, a pump volume, or a pump rate, including: generating, based on at least one of fracture diagnostic data or fracture model data, a graph including fracture hits versus distance, where the fracture hits correspond to hydraulic fractures that approximate a target fracture dimension; hydraulic fracturing a stage of a hydrocarbon well to form hydraulic fractures extending into a surrounding formation; during the hydraulic fracturing of the stage of the hydrocarbon well, measuring, via a monitor well positioned in a same bench as the hydrocarbon well, an adjacent bench to the hydrocarbon well, or vertically through multiple benches within a vicinity of the hydrocarbon well, a real-time pumping parameter including a number of fracture hits that approximate the target fracture dimension in real-time; utilizing the generated graph to determine when the real-time pumping parameter is maximized; adjusting a treatment schedule for the hydraulic fracturing operation corresponding to the hydrocarbon well such that pumping of fracturing fluid will cease when the real-time pumping parameter is maximized; and hydraulic fracturing the hydrocarbon well according to the adjusted treatment schedule.

17. The method of paragraph 16, including generating the fracture model data by running a fracture simulation model.

18. The method of paragraph 16 or 17, including: hydraulic fracturing stages of a treatment well to form corresponding treatment well fractures extending into a surrounding formation; and during the hydraulic fracturing of each stage of the treatment well, measuring the fracture diagnostic data via a second monitor well positioned in a same bench as the treatment well, an adjacent bench to the treatment well, or vertically through multiple benches within a vicinity of the treatment well.

19. The method of paragraph 18, where the fracture diagnostic data include CWS data, and where the method further includes measuring the CWS data via at least one fiber optic cable that is deployed within a wellbore of the second monitor well.

20. The method of any of paragraphs 16 to 19, where the target fracture dimension includes at least one of a target fracture length or a target fracture height.

While the embodiments described herein are well-calculated to achieve the advantages set forth, it will be appreciated that such embodiments are susceptible to modification, variation, and change without departing from the spirit thereof. In other words, the particular embodiments described herein are illustrative only, as the teachings of the present techniques may be modified and practiced in different but equivalent manners apparent to those skilled in the art having the benefit of the teachings herein. Moreover, the systems and methods illustratively disclosed herein may suitably be practiced in the absence of any element that is not specifically disclosed herein and/or any optional element disclosed herein. While compositions and methods are described in terms of "comprising" or "including" various components or steps, the compositions and methods can also "consist essentially of" or "consist of" the various components and steps. Indeed, the present techniques include all alternatives, modifications, and equivalents falling within the true spirit and scope of the appended claims.

What is claimed is:

1. A method for adjusting a treatment schedule for a hydraulic fracturing operation to limit a pumping parameter, comprising:

analyzing at least one of fracture diagnostic data or fracture model data to estimate a pumping parameter at which a maximum number of hydraulic fractures will approximate a target fracture dimension during a hydraulic fracturing operation corresponding to a hydrocarbon well;

adjusting a treatment schedule for the hydraulic fracturing operation based on the estimated pumping parameter, wherein the estimated pumping parameter comprises a pump time, a pump volume, a pump rate, or combinations thereof, wherein the hydrocarbon well comprises a treatment well;

hydraulic fracturing the hydrocarbon well according to the adjusted treatment schedule by hydraulic fracturing a stage of the hydrocarbon well; and during the hydraulic fracturing of the stage of the hydrocarbon well, estimating the pumping parameter in real-time via a monitor well positioned in a same bench as the hydrocarbon well, an adjacent bench to the hydrocarbon well, or vertically through multiple benches within a vicinity of the hydrocarbon well.

2. The method of claim 1, wherein the target fracture dimension comprises at least one of a target fracture length or a target fracture height.

3. The method of claim 1, wherein the estimated pumping parameter comprises at least one of a pump time, a pump volume, or a pump rate, and wherein the method comprises estimating the pumping parameter by:

generating, based on the at least one of the fracture diagnostic data or the fracture model data, a graph comprising at least one of a fracture hit distance or a fracture height versus the pumping parameter; and estimating the pumping parameter at which the maximum number of hydraulic fractures will approximate the target fracture dimension based on the generated graph.

4. The method of claim 1, wherein the estimated pumping parameter comprises at least one of a pump time or a pump volume, and wherein the method comprises:

generating, based on the at least one of the fracture diagnostic data or the fracture model data, a graph comprising fracture hits versus distance;

commencing hydraulic fracturing of a stage of the hydrocarbon well to form hydraulic fractures extending into a surrounding formation; and during the hydraulic fracturing of the stage of the hydrocarbon well, measuring, via a monitor well positioned in a same bench as the hydrocarbon well, an adjacent bench to the hydrocarbon well, or vertically through multiple benches within a vicinity of the hydrocarbon well, a second pumping parameter comprising a number of fracture hits that approximate the target fracture dimension in real-time;

utilizing the generated graph to determine when the second pumping parameter is maximized; and adjusting the treatment schedule for the hydraulic fracturing operation corresponding to the hydrocarbon well by ceasing pumping when the second pumping parameter is maximized.

5. The method of claim 1, comprising generating the fracture model data by running a fracture simulation model.

6. The method of claim 1, comprising:

hydraulic fracturing stages of a treatment well; and during the hydraulic fracturing of each stage of the treatment well, measuring the fracture diagnostic data via a monitor well positioned in a same bench as the treatment well, an adjacent bench to the treatment well, or vertically through multiple benches within a vicinity of the treatment well.

7. The method of claim 6, wherein the fracture diagnostic data comprise cross-well strain (CWS) data, and wherein the method further comprises measuring the CWS data via at least one fiber optic cable that is deployed within a wellbore of the monitor well.

8. The method of claim 1, wherein the fracture diagnostic data comprise pressure data, and wherein the method further comprises coupling at least one pressure receiver to a wellbore of the monitor well to provide for the measurement of the pressure data.

9. A method for adjusting a treatment schedule for a hydraulic fracturing operation to limit a pumping parameter, comprising:

hydraulic fracturing stages of a treatment well to form corresponding treatment well fractures extending into a surrounding formation;

during the hydraulic fracturing of each stage of the treatment well, measuring, via a monitor well positioned in a same bench as the treatment well, an adjacent bench to the treatment well, or vertically through multiple benches within a vicinity of the treatment well, fracture diagnostic data that are indicative of fracture hits for the stage, wherein each fracture hit comprises an interaction between one of the treatment well fractures and the monitor well;

generating, based on the measured fracture diagnostic data, a graph comprising distances for the fracture hits versus a pumping parameter, wherein the pumping parameter comprises at least one of a pump time, pump volume, or a pump rate, and wherein the fracture hits correspond to treatment well fractures that approximate a target fracture dimension;

adjusting a treatment schedule for a hydraulic fracturing operation corresponding to a hydrocarbon well to limit the pumping parameter for the hydrocarbon well based on the generated graph, wherein the hydrocarbon well is located in the same bench, the adjacent bench, or a comparable bench as the treatment well and the monitor well; and hydraulic fracturing the hydrocarbon well according to the adjusted treatment schedule.

10. The method of claim 9, wherein the hydrocarbon well comprises a second treatment well, and wherein the method further comprises:

hydraulic fracturing a stage of the hydrocarbon well; and during the hydraulic fracturing of the stage of the hydrocarbon well, measuring, via a second monitor well positioned in a same bench as the hydrocarbon well, an adjacent bench to the hydrocarbon well, or vertically through multiple benches within a vicinity of the hydrocarbon well, a real-time pumping parameter, wherein the real-time pumping parameter comprises at least one of a pump time, a pump volume, or a pump rate at which a first fracture hit that approximates the target fracture dimension occurs in real-time;

wherein the adjustment of the treatment schedule for the stage of the hydrocarbon well is performed to limit the pumping parameter based on both the generated graph and the measured real-time pumping parameter.

11. The method of claim 10, wherein the limitation of the pumping parameter based on both the generated graph and the measured real-time pumping parameter comprises:

estimating a second real-time pumping parameter, wherein the second real-time pumping parameter comprises at least one of a second pump time, a second pump volume, or a second pump rate at which a last fracture hit that approximates the target fracture dimension is expected to occur; and adjusting the treatment schedule for the stage such that the pumping parameter is limited to the second real-time pumping parameter.

12. The method of claim 9, wherein the fracture diagnostic data comprise cross-well strain (CWS) data, and wherein the method further comprises deploying at least one fiber optic cable within a wellbore of the monitor well to provide for the measurement of the CWS data.

13. The method of claim 9, wherein the fracture diagnostic data comprise pressure data, and wherein the method further comprises coupling at least one pressure receiver to a wellbore of the monitor well to provide for the measurement of the pressure data.

14. The method of claim 9, wherein the target fracture dimension comprises at least one of a target fracture length or a target fracture height.

15. A method for adjusting a treatment schedule for a hydraulic fracturing operation to limit a pumping parameter, comprising:

generating, based on at least one of fracture diagnostic data or fracture model data, a graph comprising fracture hits versus distance, wherein the fracture hits correspond to hydraulic fractures that approximate a target fracture dimension;

hydraulic fracturing a stage of a hydrocarbon well to form hydraulic fractures extending into a surrounding formation;

during the hydraulic fracturing of the stage of the hydrocarbon well, measuring, via a monitor well positioned in a same bench as the hydrocarbon well, an adjacent bench to the hydrocarbon well, or vertically through multiple benches within a vicinity of the hydrocarbon well, a real-time pumping parameter comprising a number of fracture hits that approximate the target fracture dimension in real-time;

utilizing the generated graph to determine when the real-time pumping parameter is maximized;

adjusting a treatment schedule for the hydraulic fracturing operation corresponding to the hydrocarbon well such that pumping of fracturing fluid will cease when the real-time pumping parameter is maximized; and hydraulic fracturing the hydrocarbon well according to the adjusted treatment schedule.

16. The method of claim 15, comprising generating the fracture model data by running a fracture simulation model.

17. The method of claim 15, comprising:

hydraulic fracturing stages of a treatment well to form corresponding treatment well fractures extending into a surrounding formation; and during the hydraulic fracturing of each stage of the treatment well, measuring the fracture diagnostic data via a second monitor well positioned in a same bench as the treatment well, an adjacent bench to the treatment well, or vertically through multiple benches within a vicinity of the treatment well.

18. The method of claim 17, wherein the fracture diagnostic data comprise cross-well strain (CWS) data, and wherein the method further comprises measuring the CWS data via at least one fiber optic cable that is deployed within a wellbore of the second monitor well.

19. The method of claim 15, wherein the target fracture dimension comprises at least one of a target fracture length or a target fracture height.

* * * * *